US009145600B2

(12) United States Patent
Imaizumi et al.

(10) Patent No.: US 9,145,600 B2
(45) Date of Patent: Sep. 29, 2015

(54) PRECIPITATION HARDENED HEAT-RESISTANT STEEL

(75) Inventors: Kaoru Imaizumi, Aichi (JP); Naohide Kamiya, Aichi (JP)

(73) Assignee: DAIDO STEEL CO., LTD., Nagoya, Aichi (JP)

( * ) Notice: Subject to any disclaimer, the term of this patent is extended or adjusted under 35 U.S.C. 154(b) by 0 days.

(21) Appl. No.: 13/421,772

(22) Filed: Mar. 15, 2012

(65) Prior Publication Data

US 2012/0241051 A1 Sep. 27, 2012

(30) Foreign Application Priority Data

Mar. 21, 2011 (JP) ..... 2011-061863
Jan. 26, 2012 (JP) ..... 2012-013836

(51) Int. Cl.

| | |
|---|---|
| ***C22C 38/50*** | (2006.01) |
| ***C21D 6/00*** | (2006.01) |
| ***C21D 6/02*** | (2006.01) |
| ***C21D 8/02*** | (2006.01) |
| ***C21D 9/52*** | (2006.01) |
| ***C22C 38/06*** | (2006.01) |
| ***C22C 38/54*** | (2006.01) |
| ***C22C 38/58*** | (2006.01) |
| ***F28F 21/08*** | (2006.01) |

(52) U.S. Cl.

CPC ..... *C22C 38/50* (2013.01); *C21D 6/004* (2013.01); *C21D 6/02* (2013.01); *C21D 8/0236* (2013.01); *C21D 8/0247* (2013.01); *C21D 9/525* (2013.01); *C22C 38/06* (2013.01); *C22C 38/54* (2013.01); *C22C 38/58* (2013.01); *F28F 21/083* (2013.01)

(58) Field of Classification Search

USPC ..... 148/326
See application file for complete search history.

(56) References Cited

U.S. PATENT DOCUMENTS

| | | | | |
|---|---|---|---|---|
| 5,948,182 | A * | 9/1999 | Hamano et al. | 148/327 |
| 6,896,747 | B2 | 5/2005 | Hauser et al. | |
| 2003/0103859 | A1 | 6/2003 | Hauser et al. | |

FOREIGN PATENT DOCUMENTS

| | | | | |
|---|---|---|---|---|
| EP | 1312691 | A1 | 5/2003 | |
| JP | S52-085915 | A | 7/1977 | |
| JP | S60-046353 | A | 3/1985 | |
| JP | S60-221556 | A | 11/1985 | |
| JP | H 02-274843 | A | 11/1990 | |
| JP | 2000-109955 | A | 4/2000 | |
| JP | 2000109955 | A * | 4/2000 | C22C 38/00 |
| JP | 2001-158943 | A | 6/2001 | |
| JP | 2002060907 | A * | 2/2002 | C22C 38/00 |

OTHER PUBLICATIONS

European Search Report dated Aug. 9, 2012.
Chinese Office Action dated Feb. 2, 2015 with an English translation thereof.

* cited by examiner

*Primary Examiner* — Kaj K Olsen
*Assistant Examiner* — Alexander Polyansky
(74) *Attorney, Agent, or Firm* — McGinn IP Law Group, PLLC.

(57) ABSTRACT

The present invention relates to a precipitation hardened heat-resistant steel containing, in terms of % by mass: 0.005 to 0.2% of C, not more than 2% of Si, 1.6 to 5% of Mn, 15% or more and less than 20% of Ni, 10 to 20% of Cr, more than 2% and up to 4% of Ti, 0.1 to 2% of Al, and 0.001 to 0.02% of B, with the balance being Fe and inevitable impurities, in which a ratio (Ni/Mn) of an amount of Ni to an amount of Mn is 3 to 10, a total amount of Ni and Mn (Ni+Mn) is 18% or more and less than 25%, and a ratio (Ti/Al) of an amount of Ti to an amount of Al is 2 to 20.

4 Claims, No Drawings

PRECIPITATION HARDENED HEAT-RESISTANT STEEL

FIELD OF THE INVENTION

The present invention relates to a precipitation hardened heat-resistant steel which is optimum as parts requiring heat resistance, such as various internal combustion engines, engines for automobiles, steam turbines, heat exchangers, and heating furnaces, especially materials for heat-resistant bolts.

BACKGROUND OF THE INVENTION

In recent years, because of high efficiency and high output of a variety of heat engines, a tendency toward an increase in burning temperature, exhaust gas temperature, or steam temperature has been increased, and in response thereto, a requirement for an enhancement of strength characteristics in heat-resistant steels has been also increased. As a heat-resistant steel to be used for the foregoing heat-resistant application, JIS SUH660, that is a γ' precipitation type iron base superalloy, has hitherto been frequently used for the use at a temperature of up to 700° C. However, accompanied with high efficiency and high output of a variety of heat engines, there is a concern about a shortage of the strength. In addition, SUH660 involves such a problem that the precipitation of an η phase ($Ni_3Ti$) is brought due to the use over a long period of time, resulting in lowering of the strength and ductility. Furthermore, SUH660 contains a large quantity of expensive Ni, so that it involves such a problem that the cost becomes high.

Incidentally, as the related-art technologies relative to the invention, those disclosed in the following Patent Documents 1 and 2 are exemplified.

Patent Document 1 discloses an invention regarding "heat-resistant bolts". The invention disclosed in Patent Document 1 is aimed to obtain a heat-resistant bolt with excellent relaxation characteristics, in which by optimizing blending of chemical components and working method, even when cold working is applied, the precipitation of an η phase can be suppressed in a subsequent process at a high temperature under a high stress. However, Patent Document 1 does not mention the characteristic features of the present invention, i.e., an increase of an age-hardening amount after cold working by positively incorporating Mn; and an improvement of a balance between cold workability and high-temperature strength by specifying a total amount of Ni and Mn and a ratio thereof.

Patent Document 2 discloses an invention regarding "heat-resistant stainless steels". The invention of Patent Document 2 is aimed to provide a heat-resistant high-strength stainless steel which is excellent in high-temperature tensile strength of spring in a high-temperature zone and high-temperature permanent set resistance by controlling the precipitation amount and form of each of a γ' phase and an η phase. However, Patent Document 2 does not mention the characteristic features of the present invention, i.e., reduction of the Ni amount to achieve suppression of costs and at the same time, an improvement of a balance between cold workability and high-temperature strength, by specifying a total amount of Ni and Mn and a ratio thereof.

Patent Document 1: JP-A-2001-158943
Patent Document 2: JP-A-2000-109955

SUMMARY OF THE INVENTION

Under the foregoing circumstances, the invention has been made, and an object thereof is to provide a precipitation hardened heat-resistant steel which is lower in the Ni amount and less expensive in costs as compared with SUH660 and has higher strength than SUH660 from the standpoint of strength, and in which the precipitation of an η phase is suppressed.

Namely, the present invention provides the following items.

1. A precipitation hardened heat-resistant steel comprising, in terms of % by mass:
   from 0.005 to 0.2% of C,
   not more than 2% of Si,
   from 1.6 to 5% of Mn,
   15% or more and less than 20% of Ni,
   from 10 to 20% of Cr,
   more than 2% and up to 4% of Ti,
   from 0.1 to 2% of Al, and
   from 0.001 to 0.02% of B,
   with the balance being Fe and inevitable impurities,
   wherein a ratio (Ni/Mn) of an amount of Ni to an amount of Mn is from 3 to 10,
   wherein a total amount of Ni and Mn n) is 18% or more and less than 25%, and
   wherein a ratio (Ti/Al) of an amount of Ti to an amount of Al is from 2 to 20.

2. The precipitation hardened heat-resistant steel according to item 1 above, further comprising, in terms of % by mass, at least one of:
   not more than 5% of Cu, and
   not more than 0.05% of N.

3. The precipitation hardened heat-resistant steel according to item 1 or 2, further comprising, in terms of % by mass, at least one of:
   not more than 0.03% of Mg, and
   not more than 0.03% of Ca.

4. The precipitation hardened heat-resistant steel according to any one of items 1 to 3, further comprising, in terms of % by mass, at least one of:
   not more than 2% of Mo,
   not more than 2% of V, and
   not more than 2% of Nb.

5. The precipitation hardened heat-resistant steel according to any one of items 1 to 4, which is obtained by, after a solution heat treatment, being subjected to a cold working at a working rate of from 5 to 80% to achieve molding, followed by an aging treatment.

6. A precipitation hardened heat-resistant steel consisting essentially of, in terms of % by mass:
   from 0.005 to 0.2% of C,
   not more than 2% of Si,
   from 1.6 to 5% of Mn,
   15% or more and less than 20% of Ni,
   from 10 to 20% of Cr,
   more than 2% and up to 4% of Ti,
   from 0.1 to 2% of Al, and
   from 0.001 to 0.02% of B,
   and optionally at least one of:
   not more than 5% of Cu,
   not more than 0.05% of N,
   not more than 0.03% of Mg,
   not more than 0.03% of Ca,
   not more than 2% of Mo,
   not more than 2% of V, and
   not more than 2% of Nb,
   with the balance being Fe and inevitable impurities,
   wherein a ratio (Ni/Mn) of an amount of Ni to an amount of Mn is from 3 to 10,
   wherein a total amount of Ni and Mn (Ni+Mn) is 18% or more and less than 25%, and wherein a ratio (Ti/Al) of an amount of Ti to an amount of Al is from 2 to 20.

7. The precipitation hardened heat-resistant steel according to item 6 above, which is obtained by, after a solution heat treatment, being subjected to a cold working at a working rate of from 5 to 80% to achieve molding, followed by an aging treatment.

8. A precipitation hardened heat-resistant steel consisting of, in terms of % by mass:

from 0.005 to 0.2% of C,
not more than 2% of Si,
from 1.6 to 5% of Mn,
15% or more and less than 20% of Ni,
from 10 to 20% of Cr,
more than 2% and up to 4% of Ti,
from 0.1 to 2% of Al, and
from 0.001 to 0.02% of B,
and optionally at least one of:
not more than 5% of Cu,
not more than 0.05% of N,
not more than 0.03% of Mg,
not more than 0.03% of Ca,
not more than 2% of Mo,
not more than 2% of V, and
not more than 2% of Nb,
with the balance being Fe and inevitable impurities, wherein a ratio (Ni/Mn) of an amount of Ni to an amount of Mn is from 3 to 10, wherein a total amount of Ni and Mn (Ni+Mn) is 18% or more and less than 25%, and wherein a ratio (Ti/Al) of an amount of Ti to an amount of Al is from 2 to 20.

9. The precipitation hardened heat-resistant steel according to item 8 above, which is obtained by, after a solution heat treatment, being subjected to a cold working at a working rate of from 5 to 80% to achieve molding, followed by an aging treatment.

Mn functions to stabilize austenite and in addition, lowers stacking fault energy and increases a transition density after cold working. For that reason, Mn functions to increase a precipitation site of a γ' phase on the occasion of an aging treatment after cold working.

In response thereto, in the invention, the matrix (austenite) is solution hardened by increasing the Mn amount; and after the γ' precipitation, even when the Ni amount in the matrix is decreased, since Mn is dissolved, the strength of the matrix is maintained. As a result, according to the invention, despite that the content of Ni is made small, the strength (high-temperature strength) of the heat-resistant steel is much more heightened.

In the invention, Ti is also a constituent component of the γ' phase. In this sense, when the content of Ti is increased, the heat-resistant steel can be highly hardened. On the other hand, when the Ti amount is excessively increased, the η phase tends to precipitate easily. That is, the η phase precipitates during the use of the heat-resistant steel, resulting in deteriorating the characteristics.

Accordingly, in the invention, the precipitation of the η phase is suppressed by appropriately specifying a ratio of Ti and Al, to thereby form a material which hardly causes a change over the years.

In the light of the above, the Ni amount of SUH660 which has hitherto been widely used is large as from 24 to 27%. On the other hand, in the invention, the Ni amount is decreased to 15% or more and less than 20%, thereby contriving to reduce the costs.

However, Ni is an element for stabilizing austenite. Accordingly, if the Ni amount is made merely small, the austenite becomes instable.

Then, according to the invention, the content of Mn that is similarly an element for stabilizing austenite is increased, thereby compensating the reduction of the Ni amount by increasing the Mn content.

Next, reasons why the addition and addition amount of each of the chemical components in the invention are limited are hereunder described. Herein, in an embodiment, the precipitation hardened heat-resistant steel according to the invention comprises the essential elements (C, Si, Mn, Ni, Cr, Ti, Al and B in amounts mentioned below) with the balance being Fe and inevitable impurities. The steel may further comprise the optional element(s) (Cu, N, Mg, Ca, Mo, V and Nb in amount(s) mentioned below). In another embodiment, the precipitation hardened heat-resistant steel according to the invention consists essentially of the essential elements and optionally the optional element(s), with the balance being Fe and inevitable impurities. In still another embodiment, the precipitation hardened heat-resistant steel according to the invention consists of the essential elements and optionally the optional element(s), with the balance being Fe and inevitable impurities.

C: From 0.005 to 0.2%

C is an element which is effective for enhancing the high-temperature strength of the matrix upon being bound with Cr and Ti to form a carbide. For that reason, it is necessary to incorporate C in an amount of 0.005% or more.

However, when C is excessively incorporated, the formation amount of the carbide becomes too large, the corrosion resistance is deteriorated, and the toughness of an alloy is lowered. Thus, an upper limit of the C content is set to 0.2%.

Si: Not More than 2%

Si is effective as a deoxidizer at the time of smelting and refining of an alloy, and the presence of an appropriate amount of Si enhances the oxidation resistance. Thus, Si can be incorporated.

But, when a large quantity of Si is incorporated, the toughness of an alloy is deteriorated, and the workability is impaired. Thus, the content of Si is set to not more than 2%.

Mn: From 1.6 to 5%

Similar to Ni, Mn is an element for forming austenite and enhances the heat resistance of an alloy.

When the content of Mn is less than 1.6%, the ductility and the high-temperature strength after cold working are lowered. Thus, a lower limit of the content of Mn is set to 1.6%. The lower limit of the content of Mn is preferably 1.8%.

When Mn is incorporated in an amount exceeding 5%, the formation of a γ' phase: $Ni_3(Al,Ti)$ that is a hardening phase is hindered, and the high-temperature strength is lowered. Thus, an upper limit of the content of Mn is set to 5%. The upper limit of the content of Mn is preferably 3%.

Ni: 15% or More and Less than 20%

Similar to Mn, Ni is an element for forming austenite and enhances the heat resistance and corrosion resistance of an alloy. Also, Ni is an important element for securing the high-temperature strength upon forming a γ' phase: $Ni_3(Al,Ti)$ that is a hardening phase. When the content of Ni is less than 15%, the austenite cannot be stabilized, and the high-temperature strength of the alloy is lowered. Thus, a lower limit of the content of Ni is set to 15%. The lower limit of the content of Ni is preferably 17%.

When Ni is incorporated in an amount of 20% or more, the costs become high. Thus, an upper limit of the content of Ni is set to less than 20%. The upper limit of the content of Ni is preferably 19%.

Cr: From 10 to 20%

Cr is an essential element for securing the resistance to high-temperature oxidation and corrosion of an alloy. For that reason, it is necessary to incorporate Cr in an amount of 10% or more.

However, when Cr is incorporated in an amount exceeding 20%, a σ phase precipitates, whereby not only the toughness of an alloy is lowered, but the high-temperature strength is lowered. Thus, an upper limit of the content of Cr is set to 20%.

Ti: More than 2% and Up to 4%

Similar to Al, Ti is an element for forming a γ' phase which is effective for enhancing the high-temperature strength upon being bound with Ni. However, when the content of Ti is not more than 2%, the hardening ability owing to the precipitation of a γ' phase is lowered, and the sufficient high-temperature strength cannot be secured. Thus, a lower limit of the content of Ti is set to more than 2%.

On the other hand, when Ti is excessively incorporated, the workability of the alloy is impaired, an η phase: $Ni_3Ti$ easily precipitates, and the high-temperature strength and ductility of an alloy are deteriorated. Thus, an upper limit of the content of Ti is set to 4%.

Al: From 0.1 to 2%

Al is the most important element for forming a γ' phase: $Ni_3(Al,Ti)$ upon being bound with Ni, and when its content is too small, the precipitation of a γ' phase becomes insufficient, and the high-temperature strength cannot be secured. For that reason, a lower limit of the content of Al is set to 0.1%. The lower limit of the content of Al is preferably 0.2%, and more preferably more than 0.5%. On the other hand, when Al is excessively incorporated, the workability of an alloy is impaired. Thus, an upper limit of the content of Al is set to 2%. The upper limit of the content of Al is preferably set to less than 1%.

B: From 0.001 to 0.02%

B segregates at a grain boundary to harden the boundary and improves the hot workability of an alloy. Thus, B can be incorporated into the alloy of the invention. However, the foregoing effects are obtained when the content of B is 0.001% or more.

On the other hand, when B is incorporated in an amount exceeding 0.02%, the hot workability is rather impaired. Thus, an upper limit of the content of B is set to 0.02%.

Ni/Mn: From 3 to 10

When a ratio (Ni/Mn) of the amount of Ni to the amount of Mn is less than 3, the precipitation of a γ' phase that is hardening phase becomes insufficient, and the high-temperature strength is lowered. Thus, a lower limit of the Ni/Mn ratio is set to 3. The lower limit of the Ni/Mn ratio is preferably 7.

When the Ni/Mn ratio exceeds 10, the ductility and the high-temperature strength after cold working are lowered. Thus, an upper limit of the Ni/Mn ratio is set to 10. The upper limit of the Ni/Mn ratio is preferably 9.

Ni+Mn: 18% or More and Less than 25%

Each of Ni and Mn is an element for forming austenite that is a base and enhances the high-temperature strength.

When the total amount of Ni and Mn (Ni+Mn) is less than 18%, austenite cannot be stabilized, and the sufficient high-temperature strength is not obtained. Thus, a lower limit of the total amount of Ni and Mn (Ni+Mn) is set to 18%. The lower limit of the total amount of Ni and Mn (Ni+Mn) is preferably 20%.

When the total amount of Ni and Mn (Ni+Mn) is 25% or more, the workability of an alloy is impaired, and the strength is lowered due to the excessive stabilization of austenite. Thus, an upper limit of the total amount of Ni and Mn (Ni+Mn) is set to less than 25%. The upper limit of the total amount of Ni and Mn (Ni+Mn) is preferably 23%.

Ti/Al: From 2 to 20

When a ratio (Ti/Al) of the amount of Ti to the amount of Al is less than 2, misfit between the γ' phase and the matrix is lowered, and the high-temperature strength is lowered. Thus, a lower limit of the Ti/Al ratio is set to 2. The lower limit of the Ti/Al ratio is preferably 3.

When the Ti/AI ratio exceeds 20, the workability of an alloy is deteriorated, the precipitation of an η phase is brought during the use over a long period of time, and the ductility is deteriorated. Thus, an upper limit of the Ti/Al ratio is set to 20. The upper limit of the Ti/Al ratio is preferably 11, and more preferably 7.

Cu: Not More than 5%

Cu has an action to enhance the adhesion of an oxide film at a high temperature, thereby enhancing the oxidation resistance. Thus, Cu may be incorporated in the alloy. However, even when Cu is incorporated in a large quantity exceeding 5%, not only the oxidation resistance is not enhanced, but the hot workability of an alloy is deteriorated. Thus, an upper limit of the content of Cu is set to 5%.

N: Not More than 0.05%

N stabilizes austenite and enhances the high-temperature strength. Thus, N may be incorporated in the alloy of the invention.

However, when N is incorporated in an amount exceeding 0.05%, the workability is conspicuously impaired. Thus, an upper limit of the content of N is set to 0.05%.

Mg: Not More than 0.03%, Ca: Not More than 0.03%

Both of Mg and Ca are an element having a deoxidation or desulfurization action at the time of alloy ingoting. Thus, at least one of Mg and Ca may be incorporated into the alloy.

But, when either one of Mg and Ca is excessively incorporated, the hot workability is lowered. Thus, an upper limit of the content of each of Mg and Ca is set to 0.03%.

Mo: Not More than 2%, V: Not More than 2%, Nb: Not More than 2%

All of Mo, V, and Nb are an element for enhancing the high-temperature strength of an alloy by solution hardening. Thus, at least one of Mo, V, and Nb may be incorporated into the alloy of the invention.

However, when either one of Mo, V, and Nb is incorporated in an amount exceeding 2%, not only the costs become high, but the workability is impaired. Thus, an upper limit of the content of each of Mo, V, and Nb is set to 2%.

In this regard, with regard to each element contained in the steel of the invention, according to an embodiment, the minimal amount thereof present in the steel is the smallest non-zero amount used in the Examples of the developed steels as summarized in Table 1-I. According to a further embodiment, the maximum amount thereof present in the steel is the maximum amount used in the Examples of the developed steels as summarized in Table 1-I.

BEST MODE FOR CARRYING OUT THE INVENTION

Next, embodiments of the invention are hereunder described in detail.

50 kg of each alloy having a chemical composition shown in Tables 1-I and 1-II was ingoted by a high-frequency induction furnace, and each resulting ingot was subjected to hot forging to fabricate a rod material having a diameter of 20 mm.

This rod material was heated at 1,000° C. for one hour and then subjected to a solution heat treatment under a condition of water cooling. The material thus fabricated was subjected to tensile test, observation of microstructure, and evaluation of cold workability.

(I) Tensile Test:

A material having been subjected to the foregoing solution heat treatment was heated at 700° C. for 16 hours without applying cold working, and then subjected to an aging treatment under a condition of air cooling. Separately, a material having been subjected to the foregoing solution heat treatment was subjected to a cold working at a reduction of area of 30%, and it was then heated at 700° C. for 16 hours, followed by being subjected to an aging treatment under a condition of air cooling. These materials were respectively subjected to a tensile test at 650° C.

The tensile test was performed in accordance with JIS G0567.

(II) Microstructure:

After the foregoing solution heat treatment, the material was heated at 650° C. for 20 days, subjected to an aging treatment under a condition of air cooling, and then subjected to observation of a microstructure by a scanning electron microscope with a magnification of 5,000 times, thereby examining the presence or absence of the precipitation of an η phase.

The evaluation was made in such a manner that the case where the precipitation of an η phase was not recognized is designated as "A", and the precipitation of an η phase was recognized is designated as "B".

(III) Cold workability:

A specimen having a diameter of 6 mm and a height of 9 mm was cut out from the material having been subjected to the foregoing solution heat treatment, subjected to a compression test at a working rate of 60%, and then observed for the presence or absence of any crack, thereby evaluating the cold workability.

Here, the cold workability was evaluated in such a manner that the case where any crack was not recognized is designated as "A", and a crack was recognized is designated as "B".

These results are shown in Tables 2-I and 2-II.

TABLE 1-I

| | | Chemical composition | | | | | | | | | | | |
|---|---|---|---|---|---|---|---|---|---|---|---|---|---|
| | | Chemical component (% by mass) | | | | | | | | | | | |
| | | C | Si | Mn | Ni | Cr | Ti | Al | B | Others | Ni + Mn | Ni/Mn | Ti/Al |
| Example | 1 | 0.055 | 0.55 | 2.31 | 18.04 | 15.40 | 2.35 | 0.76 | 0.0050 | | 20.35 | 7.81 | 3.09 |
| | 2 | 0.051 | 0.52 | 1.87 | 18.10 | 15.02 | 2.27 | 0.77 | 0.0064 | | 19.97 | 9.68 | 2.95 |
| | 3 | 0.051 | 0.52 | 3.55 | 18.07 | 15.03 | 2.23 | 0.72 | 0.0047 | | 21.62 | 5.09 | 3.10 |
| | 4 | 0.051 | 0.52 | 4.02 | 18.00 | 15.03 | 2.33 | 0.80 | 0.0042 | | 22.02 | 4.48 | 2.91 |
| | 5 | 0.049 | 0.53 | 3.21 | 15.52 | 15.02 | 2.21 | 0.78 | 0.0053 | | 18.73 | 4.83 | 2.83 |
| | 6 | 0.052 | 0.54 | 1.98 | 16.46 | 15.04 | 2.25 | 0.71 | 0.0058 | | 18.44 | 8.31 | 3.17 |
| | 7 | 0.065 | 0.55 | 2.03 | 19.49 | 15.40 | 2.36 | 0.74 | 0.0061 | | 21.52 | 9.60 | 3.19 |
| | 8 | 0.046 | 0.55 | 2.04 | 17.98 | 15.40 | 2.38 | 0.51 | 0.0049 | | 20.02 | 8.81 | 4.67 |
| | 9 | 0.055 | 0.48 | 2.06 | 18.13 | 15.00 | 2.20 | 1.01 | 0.0057 | | 20.19 | 8.80 | 2.18 |
| | 10 | 0.047 | 0.53 | 1.99 | 17.89 | 14.03 | 3.11 | 1.54 | 0.0044 | | 19.88 | 8.99 | 2.02 |
| | 11 | 0.058 | 0.58 | 1.99 | 18.23 | 15.50 | 3.90 | 1.92 | 0.0041 | | 20.22 | 9.16 | 2.03 |
| | 12 | 0.059 | 0.53 | 2.01 | 18.04 | 14.93 | 2.11 | 0.76 | 0.0065 | | 20.05 | 8.98 | 2.78 |
| | 13 | 0.058 | 0.57 | 2.00 | 18.00 | 15.02 | 2.48 | 0.78 | 0.0053 | | 20.00 | 9.00 | 3.18 |
| | 14 | 0.051 | 0.51 | 2.03 | 17.93 | 15.13 | 3.11 | 0.72 | 0.0054 | | 19.96 | 8.83 | 4.32 |
| | 15 | 0.042 | 0.55 | 1.97 | 18.04 | 15.50 | 3.98 | 0.76 | 0.0068 | | 20.01 | 9.16 | 5.24 |
| | 16 | 0.057 | 0.58 | 2.77 | 15.23 | 14.88 | 2.19 | 0.75 | 0.0048 | | 18.00 | 5.50 | 2.92 |
| | 17 | 0.083 | 0.61 | 2.90 | 19.07 | 14.69 | 2.33 | 0.81 | 0.0051 | | 21.97 | 6.57 | 2.88 |
| | 18 | 0.036 | 0.55 | 4.51 | 19.96 | 13.80 | 2.25 | 0.76 | 0.0070 | | 24.47 | 4.43 | 2.96 |
| | 19 | 0.057 | 0.47 | 4.83 | 15.03 | 15.21 | 2.21 | 0.72 | 0.0055 | | 19.86 | 3.11 | 3.07 |
| | 20 | 0.053 | 0.59 | 3.33 | 16.65 | 15.00 | 2.37 | 0.77 | 0.0039 | V: 0.37 | 19.98 | 5.00 | 3.08 |
| | 21 | 0.047 | 0.61 | 2.25 | 18.01 | 15.01 | 2.30 | 0.71 | 0.0042 | Nb: 0.18 | 20.26 | 8.00 | 3.24 |
| | 22 | 0.056 | 0.52 | 2.01 | 19.71 | 15.09 | 2.23 | 0.74 | 0.0059 | N: 0.008 | 21.72 | 9.81 | 3.01 |
| | 23 | 0.051 | 0.50 | 2.02 | 18.10 | 15.23 | 2.26 | 1.00 | 0.0058 | Mo: 0.28 | 20.12 | 8.96 | 2.26 |
| | 24 | 0.054 | 0.48 | 2.01 | 17.99 | 15.12 | 2.49 | 0.43 | 0.0048 | Mg: 0.007 | 20.00 | 8.95 | 5.79 |
| | 25 | 0.058 | 0.44 | 1.99 | 17.92 | 15.08 | 3.59 | 0.36 | 0.0062 | Ca: 0.005 | 19.91 | 9.01 | 9.97 |
| | 26 | 0.120 | 0.51 | 2.19 | 18.14 | 15.04 | 2.29 | 0.72 | 0.0059 | N: 0.031 | 20.33 | 8.28 | 3.18 |
| | 27 | 0.057 | 1.48 | 2.06 | 18.10 | 15.09 | 2.31 | 0.77 | 0.0054 | | 20.16 | 8.79 | 3.00 |
| | 28 | 0.049 | 0.55 | 2.13 | 18.02 | 11.03 | 2.24 | 0.75 | 0.0057 | Mo: 1.13 | 20.15 | 8.46 | 2.99 |
| | 29 | 0.057 | 0.49 | 2.05 | 18.07 | 18.75 | 2.33 | 0.74 | 0.0048 | | 20.12 | 8.81 | 3.15 |
| | 30 | 0.053 | 0.53 | 2.01 | 17.96 | 15.13 | 2.25 | 0.71 | 0.0051 | Cu: 2.17, V: 1.57 | 19.97 | 8.94 | 3.17 |
| | 31 | 0.048 | 0.41 | 1.98 | 18.03 | 15.02 | 2.26 | 0.78 | 0.0130 | Nb: 1.38 | 20.01 | 9.11 | 2.90 |
| | 32 | 0.039 | 0.53 | 1.89 | 18.12 | 15.11 | 2.62 | 0.43 | 0.0042 | | 20.01 | 9.59 | 6.09 |
| | 33 | 0.054 | 0.58 | 2.03 | 18.07 | 15.23 | 2.69 | 0.31 | 0.0051 | | 20.10 | 8.90 | 8.68 |
| | 34 | 0.048 | 0.52 | 2.12 | 18.02 | 14.87 | 2.73 | 0.25 | 0.0048 | | 20.14 | 8.50 | 10.92 |
| | 35 | 0.047 | 0.48 | 2.18 | 18.12 | 15.04 | 3.99 | 0.32 | 0.0056 | | 20.30 | 8.31 | 12.47 |

TABLE 1-II

| | | Chemical composition | | | | | | | | | | | |
|---|---|---|---|---|---|---|---|---|---|---|---|---|---|
| | | Chemical component (% by mass) | | | | | | | | | | | |
| | | C | Si | Mn | Ni | Cr | Ti | Al | B | Others | Ni + Mn | Ni/Mn | Ti/Al |
| Comparative Example | 1 | 0.051 | 0.37 | 0.11 | 24.11 | 13.89 | 2.01 | 0.17 | 0.0031 | Mo: 1.04, V: 0.47 | 24.22 | 219.18 | 11.82 |
| | 2 | 0.049 | 0.55 | 0.91 | 18.03 | 15.03 | 2.31 | 0.77 | 0.0049 | | 18.94 | 19.81 | 3.00 |
| | 3 | 0.051 | 0.51 | 6.03 | 18.00 | 15.12 | 2.22 | 0.72 | 0.0054 | | 24.03 | 2.99 | 3.08 |
| | 4 | 0.054 | 0.47 | 3.70 | 13.02 | 14.98 | 2.26 | 0.70 | 0.0052 | | 16.72 | 3.52 | 3.23 |
| | 5 | 0.044 | 0.52 | 2.04 | 18.04 | 15.03 | 2.25 | 0.05 | 0.0039 | | 20.08 | 8.84 | 45.00 |
| | 6 | 0.053 | 0.47 | 1.97 | 18.11 | 15.04 | 2.25 | 2.47 | 0.0053 | | 20.08 | 9.19 | 0.91 |
| | 7 | 0.056 | 0.53 | 1.87 | 17.89 | 15.13 | 1.72 | 0.76 | 0.0048 | | 19.76 | 9.57 | 2.26 |
| | 8 | 0.048 | 0.39 | 2.04 | 17.99 | 14.89 | 5.23 | 0.73 | 0.0061 | | 20.03 | 8.82 | 7.16 |
| | 9 | 0.053 | 0.58 | 2.03 | 15.02 | 14.97 | 2.28 | 0.72 | 0.0054 | | 17.05 | 7.40 | 3.17 |
| | 10 | 0.056 | 0.54 | 6.43 | 25.63 | 15.00 | 2.21 | 0.77 | 0.0050 | | 32.06 | 3.99 | 2.87 |
| | 11 | 0.052 | 0.48 | 7.00 | 13.00 | 14.87 | 2.32 | 0.71 | 0.0048 | | 20.00 | 1.86 | 3.27 |
| | 12 | 0.050 | 0.51 | 1.61 | 19.94 | 15.01 | 2.27 | 0.80 | 0.0049 | | 21.55 | 12.39 | 2.84 |
| | 13 | 0.052 | 0.50 | 2.11 | 18.03 | 14.88 | 2.02 | 1.99 | 0.0054 | | 20.14 | 8.55 | 1.02 |
| | 14 | 0.044 | 0.48 | 1.99 | 18.23 | 14.96 | 2.82 | 0.12 | 0.0046 | | 20.22 | 9.16 | 23.90 |

TABLE 2-I

| | | Without cold working (Aging at 700° C. for 16 hours) Tensile strength (at 650° C.) | | | Cold working rate: 30% (Aging at 700° C. for 16 hours) Tensile strength (at 650° C.) | | | Results of observation of | |
|---|---|---|---|---|---|---|---|---|---|
| | | 0.2% offset yield strength (MPa) | Tensile strength (MPa) | Elongation (%) | 0.2% offset yield strength (MPa) | Tensile strength (MPa) | Elongation (%) | microstructure (precipitation of η phase) | Cold workability |
| Example | 1 | 663 | 903 | 27.8 | 791 | 1057 | 28.3 | A | A |
| | 2 | 682 | 928 | 26.5 | 813 | 1042 | 24.8 | A | A |
| | 3 | 641 | 861 | 30.2 | 781 | 983 | 26.9 | A | A |
| | 4 | 619 | 825 | 27.1 | 746 | 958 | 28.3 | A | A |
| | 5 | 633 | 901 | 28.4 | 804 | 1032 | 29.1 | A | A |
| | 6 | 673 | 920 | 26.2 | 869 | 1052 | 27.9 | A | A |
| | 7 | 714 | 948 | 25.6 | 884 | 1072 | 26.8 | A | A |
| | 8 | 693 | 904 | 25.5 | 804 | 1053 | 26.8 | A | A |
| | 9 | 662 | 941 | 25.9 | 873 | 1063 | 27.3 | A | A |
| | 10 | 675 | 916 | 23.9 | 808 | 1098 | 23.8 | A | A |
| | 11 | 664 | 935 | 25.8 | 813 | 1042 | 26.3 | A | A |
| | 12 | 611 | 834 | 26.1 | 728 | 951 | 25.4 | A | A |
| | 13 | 659 | 889 | 24.6 | 763 | 994 | 22.9 | A | A |
| | 14 | 676 | 922 | 23.3 | 803 | 1036 | 24.7 | A | A |
| | 15 | 723 | 958 | 20.4 | 837 | 1089 | 20.9 | A | A |
| | 16 | 629 | 845 | 29.3 | 721 | 948 | 28.5 | A | A |
| | 17 | 662 | 893 | 23.2 | 762 | 994 | 24.6 | A | A |
| | 18 | 702 | 954 | 28.4 | 804 | 1053 | 27.4 | A | A |
| | 19 | 673 | 913 | 24.7 | 816 | 1039 | 25.5 | A | A |
| | 20 | 672 | 940 | 24.3 | 801 | 1073 | 26.3 | A | A |
| | 21 | 654 | 938 | 26.9 | 769 | 1098 | 25.8 | A | A |
| | 22 | 663 | 891 | 24.5 | 751 | 973 | 25.8 | A | A |
| | 23 | 614 | 867 | 26.1 | 752 | 983 | 25.3 | A | A |
| | 24 | 682 | 918 | 25.0 | 803 | 1064 | 24.2 | A | A |
| | 25 | 721 | 956 | 23.6 | 821 | 1132 | 21.6 | A | A |
| | 26 | 679 | 941 | 25.1 | 811 | 1073 | 28.1 | A | A |
| | 27 | 688 | 958 | 24.7 | 824 | 1093 | 26.3 | A | A |
| | 28 | 651 | 890 | 27.2 | 784 | 1049 | 28.4 | A | A |
| | 29 | 668 | 911 | 25.3 | 798 | 1065 | 26.9 | A | A |
| | 30 | 677 | 934 | 26.3 | 823 | 1079 | 27.4 | A | A |
| | 31 | 669 | 912 | 27.4 | 801 | 1059 | 27.8 | A | A |
| | 32 | 628 | 869 | 26.3 | 751 | 986 | 25.3 | A | A |
| | 33 | 682 | 918 | 25.0 | 803 | 1064 | 24.2 | A | A |
| | 34 | 716 | 948 | 23.4 | 817 | 1142 | 22.1 | A | A |
| | 35 | 718 | 934 | 8.9 | 921 | 1103 | 9.1 | A | A |

TABLE 2-II

| | | Without cold working (Aging at 700° C. for 16 hours) Tensile strength (at 650° C.) | | | Cold working rate: 30% (Aging at 700° C. for 16 hours) Tensile strength (at 650° C.) | | | Results of observation of | |
|---|---|---|---|---|---|---|---|---|---|
| | | 0.2% offset yield strength (MPa) | Tensile strength (MPa) | Elongation (%) | 0.2% offset yield strength (MPa) | Tensile strength (MPa) | Elongation (%) | microstructure (precipitation of η phase) | Cold workability |
| Comparative Example | 1 | 568 | 714 | 21.9 | 661 | 826 | 24.9 | B | A |
| | 2 | 642 | 833 | 18.9 | 651 | 861 | 19.2 | A | A |
| | 3 | 492 | 743 | 18.2 | 538 | 779 | 19.1 | A | B |
| | 4 | 447 | 704 | 24.9 | 503 | 718 | 24.3 | A | A |
| | 5 | 452 | 788 | 24.8 | 507 | 815 | 25.8 | B | A |
| | 6 | 678 | 923 | 10.6 | 811 | 1134 | 12.7 | A | B |
| | 7 | 554 | 736 | 25.3 | 581 | 823 | 24.2 | A | A |
| | 8 | 781 | 1012 | 7.2 | 825 | 1167 | 6.2 | B | B |
| | 9 | 521 | 781 | 26.8 | 621 | 911 | 27.1 | A | A |
| | 10 | 583 | 761 | 21.1 | 635 | 894 | 19.4 | A | B |
| | 11 | 438 | 751 | 24.0 | 508 | 818 | 23.8 | A | A |
| | 12 | 674 | 889 | 26.2 | 655 | 881 | 24.5 | A | B |
| | 13 | 569 | 713 | 20.1 | 610 | 768 | 21.2 | A | A |
| | 14 | 735 | 982 | 19.1 | 837 | 1211 | 19.7 | B | A |

In Table Comparative Example 1 is a material corresponding to JIS SUH660. In this material, the Ni amount is 24.11%, a value of which is larger than the upper limit value (i.e., less than 20%) of the invention, and the Mn amount is 0.11%, a value of which is smaller than the lower limit value (i.e., 1.6%) of the invention; and therefore, the value of the Ni/Mn ratio is conspicuously high.

In the material of this Comparative Example 1, since the Ni amount is large, the material costs are naturally high, and in addition, as shown in Table 2-II, the η phase precipitates. Furthermore, the tensile strength at 650° C. is a low value as compared with those of the Examples.

Furthermore, since the Ni/Mn ratio is high, the tensile strength after the cold working is also a low value.

In Comparative Example 2, the Mn amount is 0.91% and is lower than the lower limit value (i.e., 1.6%) of the invention; and in accordance with this, the Ni/Mn ratio is 19.81, a value of which is higher than the upper limit value (i.e., 10) of the invention. For that reason, the tensile strength of the material subjected to the cold working and the subsequent aging treatment is not substantially different from the tensile strength of the material subjected the aging treatment without the cold working.

This is because the Ni/Mn ratio is high, so that the transition density after the cold working is low.

In Comparative Example 3, the Mn amount is 6.03%, a value of which is inversely higher than the upper limit value of the invention, and the value of the Ni/Mn ratio is 2.99, a value of which is lower than the lower limit value of the invention.

For that reason, the high-temperature strength exhibits a low value.

In Comparative Example 4, the Ni amount is small, and the total amount of Ni and Mn (Ni+Mn) is low. In accordance with this, the high-temperature strength is low.

In Comparative Example 5, the content of Al is lower than the lower limit value of the invention, and the precipitation of an η phase is insufficient. For that reason, the value of the high-temperature strength is low.

In Comparative Example 6, the amount of Al is higher than the upper limit value of the invention, so that the cold workability is poor.

In Comparative Example 7, the amount of Ti is lower than the lower limit value of the invention, and the value of the high-temperature strength is low.

Conversely, in Comparative Example 8, the amount of Ti is higher than the upper limit value of the invention, and the precipitation of an η phase is brought, and at the same time, the cold workability is poor.

In Comparative Example 9, the total amount of Ni and Mn (Ni+Mn) is lower than the lower limit value of the invention, and the value of the high-temperature strength is low.

In Comparative Example 10, both the Mn amount and the Ni amount are higher than the upper limit values of the invention, respectively, and the total amount of Ni and Mn (Ni+Mn) is high. For that reason, not only the high-temperature tensile strength is low, but the cold workability is poor.

In Comparative Example 11, the Mn amount is higher than the upper limit value of the invention. On the other hand, the Ni amount is lower than the lower limit value of the invention. In accordance with this, the Ni/Mn ratio is 1.86, a value of which is lower than the lower limit value (i.e., 3) of the invention, and the high-temperature strength is insufficient.

Conversely, in Comparative Example 12, the Ni/Mn ratio is higher than the upper limit value of the invention, and the stacking fault energy is low. For that reason, the transition density after the cold working is low, and the value of the high-temperature tensile strength of the material after the cold working and the subsequent aging treatment is not substantially different from that of the high-temperature tensile strength of the material after the aging treatment without cold working.

In Comparative Example 13, the value of the Ti/Al ratio is low, and the high-temperature hardening is not sufficiently achieved.

On the other hand, in Comparative Example 14, the Ti/Al ratio is higher than the upper limit value of the invention, and the precipitation of an η phase was recognized.

Compared to these Comparative Examples, favorable results are obtained in all of the Examples of the invention.

While the invention has been described in detail and with reference to specific embodiments thereof, it will be apparent to one skilled in the art that various changes and modifications can be made therein without departing from the spirit and scope thereof.

This application is based on Japanese patent application No. 2011-061863 filed Mar. 21, 2011 and Japanese patent application No. 2012-013836 filed Jan. 26, 2012, the entire contents thereof being hereby incorporated by reference.

What is claimed is:

1. A heat-resistant bolt consisting essentially of, in terms of % by mass:

from 0.005 to 0.2% of C,
not more than 2% of Si,
from 1.8 to 3.55% of Mn,
15% or more and less than 20% of Ni,
from 10 to 15.50% of Cr,
more than 2% and up to 4% of Ti,
from 0.1 to 2% of Al, and
from 0.001 to 0.02% of B,
and optionally at least one of:
not more than 5% of Cu,
from 0.008 to 0.05% of N,
not more than 0.03% of Mg, and
not more than 0.03% of Ca,
with the balance being Fe and inevitable impurities,
wherein a ratio (Ni/Mn) of an amount of Ni to an amount of Mn is from 4.23 to 10,
wherein a total amount of Ni and Mn (Ni+Mn) is 18% or more and less than 25%, and
wherein a ratio (Ti/Al) of an amount of Ti to an amount of Al is from 2 to 20.

2. The heat-resistant bolt according to claim 1, which is obtained by, after a solution heat treatment, being subjected to a cold working at a working rate of from 5 to 80% to achieve molding, followed by an aging treatment.

3. A heat-resistant bolt consisting of, in terms of % by mass:

from 0.005 to 0.2% of C,
not more than 2% of Si,
from 1.8 to 3.55% of Mn,
15% or more and less than 20% of Ni,
from 10 to 15.50% of Cr,
more than 2% and up to 4% of Ti,
from 0.1 to 2% of Al, and
from 0.001 to 0.02% of B,
and optionally at least one of:
not more than 5% of Cu,
from 0.008 to 0.05% of N,
not more than 0.03% of Mg, and
not more than 0.03% of Ca,
with the balance being Fe and inevitable impurities,
wherein a ratio (Ni/Mn) of an amount of Ni to an amount of Mn is from 4.23 to 10,
wherein a total amount of Ni and Mn (Ni+Mn) is 18% or more and less than 25%, and
wherein a ratio (Ti/Al) of an amount of Ti to an amount of Al is from 2 to 20.

4. The heat-resistant bolt according to claim 3, which is obtained by, after a solution heat treatment, being subjected to a cold working at a working rate of from 5 to 80% to achieve molding, followed by an aging treatment.

* * * * *